United States Patent [19]

Nygren et al.

[11] Patent Number: 4,668,097

[45] Date of Patent: May 26, 1987

[54] EPOXY MIXING SYSTEM

[75] Inventors: Gordon W. Nygren, Bloomington; Richard C. Mourning, Prior Lake, both of Minn.

[73] Assignee: Magnetic Peripherals Inc., Minneapolis, Minn.

[21] Appl. No.: 794,207

[22] Filed: Nov. 1, 1985

[51] Int. Cl.[4] ..... B01F 5/00; B01F 15/02

[52] U.S. Cl. ..... 366/162; 366/177; 366/349

[58] Field of Search ..... 366/162, 177, 182, 342, 366/348, 349

[56] References Cited

U.S. PATENT DOCUMENTS

| | | | |
|---|---|---|---|
| 2,281,497 | 4/1942 | Hyson et al. | 366/162 |
| 3,084,915 | 4/1963 | Martinez et al. | 366/177 X |
| 3,302,832 | 2/1967 | Hardman et al. | 366/162 X |
| 3,476,363 | 11/1969 | Chikamasa et al. | 366/162 |
| 3,920,223 | 11/1975 | Krueger | 366/162 X |
| 4,054,270 | 10/1977 | Gugger et al. | 366/177 X |
| 4,202,635 | 5/1980 | Hendrickson | 366/162 |
| 4,334,787 | 6/1982 | Kluth et al. | 366/162 |
| 4,538,920 | 9/1985 | Drake | 366/177 |

FOREIGN PATENT DOCUMENTS

| | | | |
|---|---|---|---|
| 3119949 | 12/1982 | Fed. Rep. of Germany | 366/177 |
| 58-16832 | 1/1983 | Japan | 366/177 |
| 335946 | 3/1959 | Switzerland | 366/182 |
| 2119269 | 11/1983 | United Kingdom | 366/349 |

*Primary Examiner*—Robert R. Mackey

*Attorney, Agent, or Firm*—Edward L. Schwarz; Joseph A. Genovese

[57] ABSTRACT

Apparatus is shown for mixing an epoxy adhesive. An epoxy resin and its associated curing agent are simultaneously loaded from separate cartridges into a length of flexible PVC tubing, part of which is contained between a rotor and a stator. Bearings, mounted rotatably about the rotor, engage and travel along the tubing as the rotor is revolved, each bearing compressing the tubing at its point of engagement. The tubing, repeatedly compressed and released by each bearing in succession, kneads the epoxy resin and curing agent into a homogeneous mixture.

10 Claims, 4 Drawing Figures

EPOXY MIXING SYSTEM

BACKGROUND OF THE INVENTION

This invention relates to an apparatus and method for mixing an epoxy resin and associated curing agent into an epoxy adhesive.

Epoxy materials are popular as adhesives due to their hardness, bonding strength, and their ability to harden with little or no shrinkage. Such adhesives typically include two constituents: an epoxy resin and a curing or hardening agent. The resin and curing agent are separately packaged until use, at which time they are combined to initiate curing.

Users of these adhesives do, however, encounter problems. Care must be taken when mixing the constituents by hand, because the constituents can be irritating to the skin and eyes, and they must be mixed in consistently accurate proportions. Users mixing and using epoxy adhesive in batches must cope with the change in the adhesive properties over curing time or "pot life". Further, cleaning of equipment used to mix and handle the epoxy adhesive is difficult, and solvents used for such cleaning can be hazardous. Prior art attempts to address some of these problems are shown, for example, in U.S. Pat. No. 4,090,262 to Schneider et al. granted May 16, 1978. Schneider shows separate tanks 1 and 2 for components "A" and "B" of a mixture, both being simultaneously propelled by a pressure source 3. Flow metering pumps 7 and 8 ensure that components A and B reach mixing chamber 16 in properly proportioned amounts. A hydraulic piston 14 positively cleans the mixing chamber. An alternate mixing chamber 20 has a stirring mechanism which must be cleaned with a solvent.

U.S. Pat. No. 2,894,732 to Taber et al. granted July 14, 1959, shows separate tanks 35 and 36 for a hardening agent and convertible resin. These components are propelled by pressure through fluid chambers 7 and 8, to a disposable mixing unit. A tube in the mixing unit is packed with metal chips 68 which cause the agent and resin to traverse "tortuous, irregularly intercommunicating flow passages", and thereby mix.

While these prior art arrangements function satisfactorily in meeting their specific requirements, they fail to adequately address the challenge of accurately and thoroughly mixing controlled amounts of epoxy adhesive and timing the dispensing of epoxy such that when used, it is consistently at or near a desired point in its curing stage.

It is therefore an object of the present invention to provide an apparatus to accurately and thoroughly mix the several components of an epoxy adhesive while requiring no direct operator contact. A further object is to reduce or eliminate the need to clean apparatus used to mix and dispense the adhesive. Yet another object of the invention is to enhance operator safety by minimizing direct contact in mixing and handling epoxy adhesive and its constituents.

SUMMARY OF THE INVENTION

To achieve these and other objects, there is provided an apparatus for combining a plurality of constituents into a substantially uniform mixture.

The apparatus includes an elongate and flexible conduit, and a supply means for simultaneously introducing a plurality of constituents into the conduit at an inlet of the conduit. A forcing means moves the constituents through the conduit from its inlet to its outlet. A conduit flexing means is provided for repeatedly compressing and releasing the conduit in a transverse direction and along a selected length of the conduit as the constituents are moved through it.

The supply means can comprise a plurability of tubes, one for each constituent, and a connector having one inlet for each tube and a single outlet to the conduit.

The forcing means can include a pneumatic cylinder and a piston reciprocable in the cylinder. Preferably, the apparatus also includes a plurality of retainers integral with the cylinder, one of the retainers adapted to contain each constituent Also provided is a plurality of plungers integral with the piston. Each plunger reciprocates in its associated retainer as the piston reciprocates in the cylinder. It is advantageous to select retainer diameters to achieve the desired proportions of the constituents.

The flexing means can comprise a rotor, a stator positioned in spaced-apart relation to the rotor, a drive means for moving the rotor, and a series of protrusions extended from the rotor, with the selected length of the conduit contained between the rotor and the stator. As the drive means move the rotor, the protrusions compress and release the conduit over the selected length. The rotor can be circular, and revolved by the drive means. The drive means can include a motor and a drive belt connecting two pulleys, one mounted to the motor and the other mounted to the rotor.

The protrusions preferably are cylindrical bearings rotatably mounted about the rotor periphery. When contacting the conduit during rotor movement, the bearings rotate in the direction opposite to that of rotor movement. A further advantage is gained from providing a groove in the stator for containing the conduit. The apparatus of this invention can be employed to practice a method for mixing a plurality of constituents into a uniform mixture comprising the steps of:

(a) simultaneously supplying a plurality of constituents to an elongate, flexible conduit; and (b) forcing the constituents through the conduit and flexing the conduit over at least a portion of its length to repeatedly compress and release the conduit in a transverse direction as the constituents are moved therethrough.

The apparatus and method of this invention provide for the thorough and proportionately accurate combination of constituents into a homogenous mixture, without any direct operator contact, thus to eliminate the risk of skin irritation or eye damage while hand mixing components. The flexible conduit can be discarded after use, eliminating the clean-up and the accompanying hazard of cleaning solvents. Also, for a given epoxy adhesive, the length of the flexible conduit and piston speed can be selected such that the adhesive mixture is presented for application at an ideal time after the initial combining of constituents.

IN THE DRAWINGS

These and other features and advantages of the invention will become apparent upon reading the following detailed description and upon reference to the drawings, in which.

DETAILED DESCRIPTION OF THE PREFERRED EMB00IMENT

Figure 1:
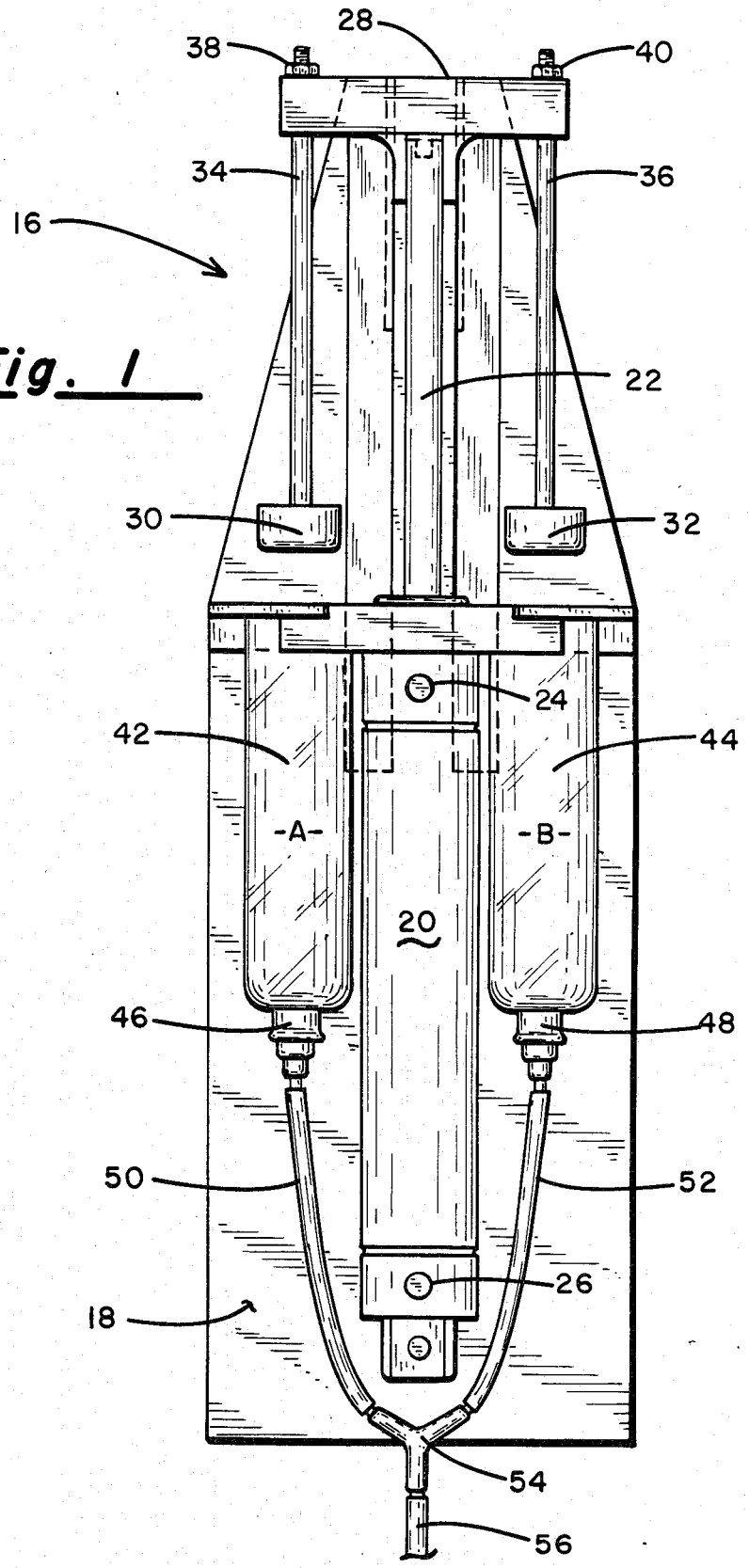
FIG. 1 is a front elevation of a constituent pumping station constructed in accordance with the present invention.

Turning now to the drawings, there is shown in FIG. 1 an epoxy pumping station 16. Station 16 includes a base 18 to which is mounted a pneumatic cylinder 20. A piston 22 reciprocates in cylinder 20. Cylinder 20 has a first air supply port 24 near its top, and a second air supply port 26 near the bottom. Pressurized air supplied to port 24 causes piston 22 to travel downward in cylinder 20, while pressurized air supplied through port 26 causes an upward, return stroke. Alternatively, second port 26 may be eliminated and piston 22 spring-loaded to return.

Mounted to the upper end of piston 22 is a bar 28. First and second plungers 30 and 32 are mounted to bar 28 on opposite sides of piston 22. The plungers have first and second plunger rods 34 and 36, which have threaded ends that enable their mounting to bar 28 using internally threaded plunger nuts 38 and 40.

Aligned with plungers 30 and 32 are a first cartridge retainer 42 and a second cartridge retainer 44, respectively. Retainers 42 and 44 are cylindrical, each having an interior diameter slightly larger than the diameter of its corresponding plunger. When in use, retainer 42 is loaded with a disposable plastic cartridge of constituent "A" which preferably is an epoxy resin. A corresponding cartridge of a constituent "B", the associated curing agent for the epoxy resin, is loaded into retainer 44. The retainers preferably are constructed of steel, and sized to contain the cartridges in a snug fit. The cartridges are commercially available, and are packed with integral pistons and with the constituents free of entrapped air.

It is seen from FIG. 1 that plungers 30 and 32 reciprocate along with piston 22 as it reciprocates, all three members traveling the same distance during each stroke. Thus, the stroke of piston 22 in cylinder 20 is set to allow removal of the plungers from their respective retainers for loading of the epoxy constituents, and in the opposite direction, to permit the plungers to completely evacuate their respective cartridges. The volume of constituent expelled is controlled by the plunger displacement and the cross-sectional area of its associated cartridge. Thus, if equal amounts of constituents A and B are desired, retainers 42 and 44 and their cartridges are of equal size. Comparative cross-sectional areas of the cartridges and retainers can be selected to meet different proportional requirements if desired.

Protruding from the cartridge bottom ends are first and second nipple ends 46 and 48, to which are connected first and second tubing elements 50 and 52, respectively. These tubing elements, in turn, are connected to the inlets of a Y-type connector 54. Connected to the outlet of Y-type connector 54 is a third tubing element 56 which comprises a common conduit for constituents A and B. While it is essential that third tubing element 56 be flexible, it is preferable that tubing elements 48 and 50 also be flexible. A suggested material for the tubing is polyvinylchloride (PVC), e.g. of a type sold under the brand name "Tygon".

Figure 2:
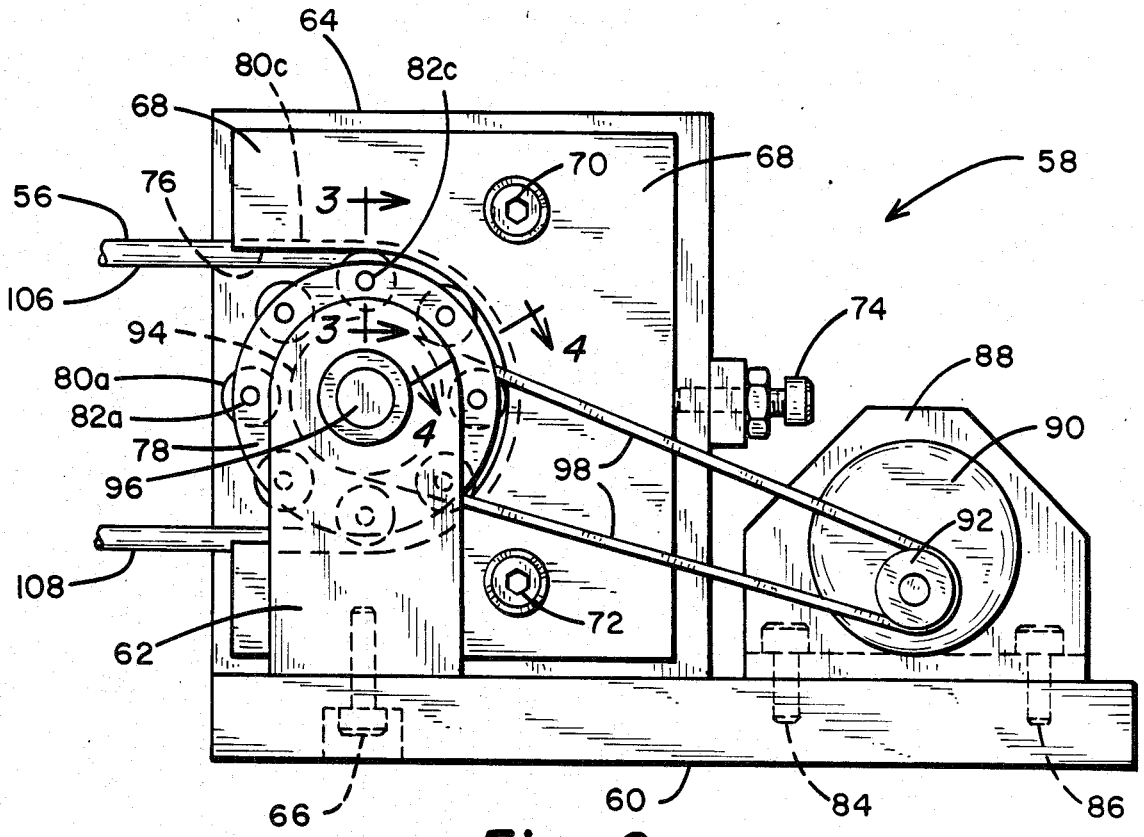
FIG. 2 is a front elevation of an epoxy mixing station constructed in accordance with the present invention.

FIG. 2 shows an epoxy mixing station 58 including a mixing station base 60, to which are mounted first and second upright frame members 62 and 64. A plurality of bolts, one of which is shown at 66, mount the frame members to the base. Attached to second frame member 64 is a stator 68, by use of first and second stator bolts 70 and 72. A stator adjust bolt 74 can be provided if desired, in which case the openings for bolts 70 and 72 in stator 68 or member 64 can be slotted to permit limited horizontal travel of the stator.

By virtue of a U-shaped opening 76, stator 68 is adapted to receive a rotor 78, supported between frame members 62 and 64 so that it revolves in the clockwise direction as viewed in FIG. 2. A series of substantially identical cylindrical bearings, two of which are identified at 80*a* and 80*c*, are mounted to rotor 78 about its periphery by means of pins, two of which are identified as 82*a* and 82*c*. The bearings rotate with respect to the rotor. Rotor 78 and stator 68 are mounted spaced apart relation to one another, to permit the threading or insertion of tubing element 56 between them, yet are sufficiently close to one another to contain the tubing element as the bearings roll along and against it.

Figure 3:
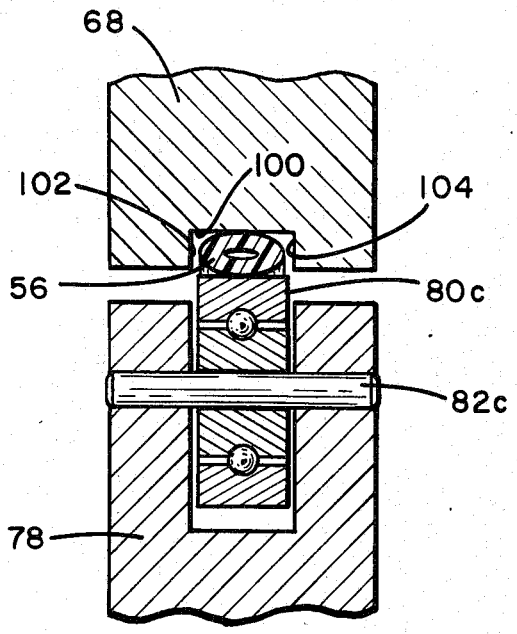
FIG. 3 is an enlarged cross-sectional view taken along the line 3—3 in FIG. 2.
Figure 4:
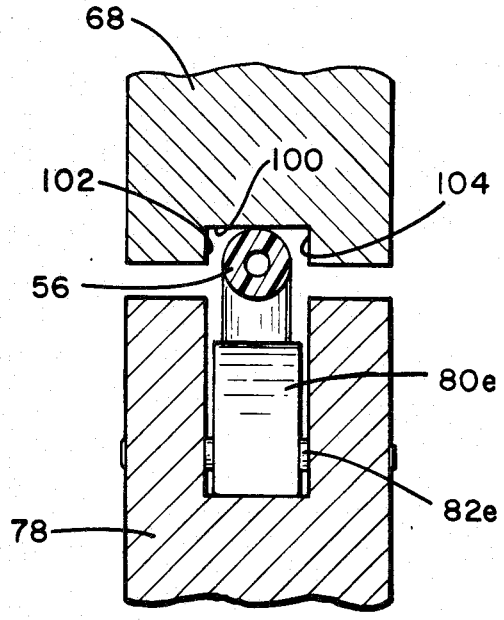
FIG. 4 is an enlarged cross-sectional view taken along the line 4—4 in FIG. 2.

Also attached to base 60, by bolts 84 and 86, is a motor support frame member 88 to which is mounted a motor 90. Attached to the shaft of motor 90 is a motor pulley 92, and a corresponding rotor pulley 94 is attached to a central shaft 96 which supports the rotor. An endless belt 98, mounted to pulleys 92 and 94, drivingly engages motor 90 and rotor 78. The containment of conduit or tubing element 56 between rotor 78 and stator 68 is best seen in FIGS. 3 and 4. Formed in the stator is a continuous groove 100 having side walls 102 and 104 which restrain tubing element 56 against axial movement with respect to the rotor and stator. Bearing 80*c* protrudes radially outwardly of the rotor perimeter to compress tubing 56 out of its normal, circular cross-section into an oval shape. Groove 100 is sized so that tubing 56 is not compressed flat, for it has been found that partial compression is sufficient for achieving thorough mixture of constituents A and B. Excessive compression would cause premature wearing of tubing 56. For example, a tubing element having a 1/16 inch interior diameter is preferably compressed to an interior height less than one half of the diameter.

From FIG. 4 it is seen that portions of tubing 56 not in contact with one of the bearings return to the normal, unstressed, circular configuration. Thus, as rotor 78 revolves in the clockwise direction as viewed in FIG. 2, each bearing 80 rotates in the opposite direction, i.e. counterclockwise. This allows each bearing to maintain contact against tubing 56 without causing undue friction between the bearing and tubing, substantially preventing wear to the tubing. As the rotor revolves, and as the epoxy constituents are pushed through tubing element 56 by plungers 30 and 32, tubing 56 is rapidly and repeatedly compressed a controlled amount, in the axial or transverse direction, at and near its areas of bearing contact, then released when between successive bearings. This produces a uniform kneading action on constituents A and B, forming them into a homogeneous mixture.

The effectiveness of rotor 78 in mixing the epoxy components can be readily observed if transparent polyvinylchloride is used for tubing element 56, and if the epoxy resin and curing agent are of different colors. Then, these constituents may be seen to resemble two-color toothpaste as they traverse an upper conduit portion 106 of tubing element 56, and emerge from the rotor in a lower conduit portion 108 as a thoroughly blended epoxy adhesive.

Thus is achieved a consistently well proportioned and homogeneous mixture of epoxy adhesive, without any direct operator contact, and without any danger of skin and eye contact with potentially harmful components. Post mixing clean-up is avoided by simply discarding third tubing element 56. There is no need to clean the rotor or stator, as these never come into direct contact with the epoxy constituents.

What we claim:

1. An apparatus for combining a plurality of constituents into a substantially uniform mixture, including:

an elongate, flexible conduit, and a supply means for simultaneously introducing a plurality of constituents into said conduit at an inlet thereof;

a forcing means for moving said constituents through said conduit from said inlet to an outlet thereof; and a conduit flexing means for repeatedly compressing and releasing said conduit in a transverse direction and along a selected length of the conduit as said constituents are moved through said conduit, said conduit flexing means comprising a rotor, a stator positioned in spaced apart relation to said rotor, a drive means for moving said rotor, and a series of protrusions extended from said rotor, and wherein said selected length of said conduit is contained between said rotor and said stator, said protrusions compressing and releasing portions of said conduit length as said drive means moves said rotor.

2. The apparatus of claim 1 wherein said supply means comprises a plurality of tubes, one for each constituent, and further comprises a connector having one inlet for each tube and a single outlet to said conduit.

3. The apparatus of claim 1 wherein said forcing means includes a pneumatic cylinder and a piston reciprocable in said cylinder.

4. The apparatus of claim 3 further including a plurality of retainers integral with said cylinder and a plurality of plungers integral with said piston, one retainer adapted to contain each constituent, each plunger reciprocating in its associated retainer as the piston reciprocates in said cylinder

5. The apparatus of claim 4 wherein the diameters of said retainers are selected to control the proportions of the constituents to one another.

6. The apparatus of claim 1 wherein said rotor is circular, and rotated by said drive means, and wherein said drive means includes a motor and a drive belt engaged with two pulleys, one pulley mounted to the motor and the other mounted to the rotor.

7. The apparatus of claim 6 wherein said protrusions comprise cylindrical bearings rotatably mounted near the perimeter of said rotor; said bearings, when contacting said conduit during rotor rotation, rotating in the direction opposite to that of rotor rotation.

8. The apparatus of claim 7 wherein said stator has a groove for containing said conduit between the stator and rotor.

9. The apparatus of claim 1 wherein said protrusions comprise cylindrical bearings rotatably mounted near the perimeter of said rotor; said bearings, when contacting said conduit during rotor movement, rotating in the direction opposite to that of rotor movement.

10. The apparatus of claim 1 wherein siad conduit is transparent.

* * * * *